US009702063B2

(12) United States Patent
Hung et al.

(10) Patent No.: US 9,702,063 B2
(45) Date of Patent: Jul. 11, 2017

(54) YARNS WITH COFFEE RESIDUES AND FABRIC AND GARMET INCLUDING THE SAME

(71) Applicant: Magictex Apparel Corporation, New Taipei (TW)

(72) Inventors: Shuo-Tlng Hung, Taipei Hsien (TW); Yi-Yen Yeh, Taipei Hsien (TW); Chien-Kuo Yen, Taipei Hsien (TW); Kuo-Chin Chen, Taipei Hsien (TW)

(73) Assignee: Magictex Apparel Corporation, New Taipei (TW)

( * ) Notice: Subject to any disclaimer, the term of this patent is extended or adjusted under 35 U.S.C. 154(b) by 313 days.

(21) Appl. No.: 14/455,518

(22) Filed: Aug. 8, 2014

(65) Prior Publication Data

US 2014/0349537 A1 Nov. 27, 2014

Related U.S. Application Data

(62) Division of application No. 11/876,201, filed on Oct. 22, 2007, now Pat. No. 8,834,753.

(51) Int. Cl.

| | |
|---|---|
| ***D02G 3/04*** | (2006.01) |
| ***D01F 1/10*** | (2006.01) |
| ***D02G 3/02*** | (2006.01) |

(52) U.S. Cl.

CPC ..... *D02G 3/04* (2013.01); *D01F 1/10* (2013.01); *D02G 3/02* (2013.01); *D10B 2321/022* (2013.01); *D10B 2331/02* (2013.01); *D10B 2331/04* (2013.01); *Y10T 428/249921* (2015.04); *Y10T 442/3171* (2015.04); *Y10T 442/3976* (2015.04); *Y10T 442/40* (2015.04); *Y10T 442/444* (2015.04); *Y10T 442/642* (2015.04); *Y10T 442/696* (2015.04)

(58) Field of Classification Search

CPC .... D01F 1/10; D02G 3/02; D02G 3/04; Y10T 428/249921; Y10T 442/3171; Y10T 442/3976; Y10T 442/40; Y10T 442/444; Y10T 442/642; Y10T 442/696

USPC ..... 8/115.51; 264/29.1, 211; 428/361, 364, 428/365, 462, 905; 442/96, 304, 414, 442/301, 221; 524/27

See application file for complete search history.

(56) References Cited

U.S. PATENT DOCUMENTS

| | | | |
|---|---|---|---|
| 3,499,851 | A | 3/1970 | Ligo |
| 2002/0037406 | A1 | 3/2002 | Takashima |
| 2002/0173583 | A1 | 11/2002 | Shimizu |
| 2004/0126662 | A1 | 7/2004 | Kohno et al. |
| 2005/0107505 | A1 | 5/2005 | Shinoda et al. |
| 2007/0148320 | A1 | 6/2007 | Uchiyama |

FOREIGN PATENT DOCUMENTS

| | | |
|---|---|---|
| CN | 1558007 | 12/2004 |
| CN | 1804166 | 7/2006 |
| CN | 101109122 | 1/2008 |
| JP | 1-280080 | 11/1989 |
| JP | 2002-6400 | 1/2002 |
| JP | 2004-2683 | 1/2004 |
| JP | 2004-68173 | 3/2004 |
| KR | 10-0813163 | 3/2008 |

*Primary Examiner* — Arti Singh-Pandey

(74) *Attorney, Agent, or Firm* — Husch Blackwell LLP

(57) ABSTRACT

The present invention provides preparation of a yarn with coffee residue. The present invention also provides a novel yarn with coffee residue and applications of the same.

11 Claims, 2 Drawing Sheets

YARNS WITH COFFEE RESIDUES AND FABRIC AND GARMET INCLUDING THE SAME

CROSS-REFERENCE TO RELATED APPLICATION

This application is a divisional application of and claims the benefit of U.S. patent application Ser. No. 11/876,201, filed on Oct. 22, 2007, now U.S. Pat. No. 8,834,753, which is incorporated herein by reference in its entirety.

FIELD OF THE INVENTION

The present invention relates to the preparation of yarn with coffee residues. The present invention also relates to a novel yarn with coffee residues.

BACKGROUND

The design and development of a functional textile providing the ability of dynamic heat regulation next to the skin have attracted more and more attention in recent years. A number of attempts in this field have been made parallel to research into electronics, several solar energy-based systems, buildings, etc. However, successful applications are limited and still under investigation.

It is well known that materials such as fabrics, clothing, and other apparel can be treated to enhance the performance characteristics associated with said materials. The performance characteristics can include, for example, odor adsorption, moisture control, ultraviolet light protection, and/or protection from external elements.

Certain materials naturally exhibit certain performance characteristics without being treated with chemicals or additives. For example, apparel constructed from an untreated material such as Lycra exhibits a moisture management characteristic. Untreated materials such as Lycra, however, may not exhibit other characteristics such as odor adsorption and/or ultraviolet protection. In addition, apparel constructed from an untreated material is limited to the physical properties (e.g., texture, feel, durability, etc.) associated with that untreated material. Moreover, the performance characteristics of such untreated materials are often limited and do not adequately enhance the utility of the untreated material.

After chemicals are applied to a fabric, however, the chemicals often dissipate and have to be reapplied continuously throughout the life of the fabric to impart the desired characteristics. The chemicals may dissipate, for example, when the treated fabric is washed or exposed to external elements.

It is therefore desirable to produce a high performance fabric that has desirable physical properties such as texture and durability, provides superior performance characteristics, and retains those performance characteristics after repeated use. Such a high performance fabric can be produced by treating the yarn or fiber prior to use of the yarn or fiber to produce a desired material.

Attempts have been made to bind solid particles such as activated carbon particles to yarn prior to producing a fabric. Activated carbon is a granular substance with particles that vary in size and shape depending on the process used to produce the activated carbon particles. The surface area of the activated carbon particles contains pores that also vary in size and shape depending on how the activated carbon particles are produced. These pores provide the activated carbon particles with properties such as odor adsorption.

One approach to binding activated carbon particles to fabric involves incasing a layer of activated carbon between two layers of fabric. This technique, however, yields an odor adsorbing fabric that is heavy and cumbersome for a person to wear. Another approach has been to incorporate the active carbon into a sheathing layer that surrounds the yarn. This approach, however, alters the physical properties of the yarn.

Human activity generates a great number of unpleasant odors in the environment. The nature of these unpleasant odors is highly varied both on account of the physical state of the unpleasant odor particles, and their chemical characteristics or their origin (such as biological decomposition, chemical agents, smoking, etc.). In addition, these unpleasant odors are generated in spaces or environments of everyday use such as the bathroom, the kitchen, the refuse, in closed environments with fumes (e.g., bars), etc. In this respect, many systems have been developed to combat such unpleasant odors.

SUMMARY OF THE INVENTION

The present invention provides a method for preparing a yarn with coffee residues, comprising (a) providing a material with coffee residues;

(b) blending the material with a polymer chip to produce a master batch; and (c) drawing a yarn from the master batch.

The present invention also provides a yarn with coffee residues, comprising a yarn and a material with coffee residues.

The present invention further provides a fabric and a garment which include the yarn of the present invention.

DETAILED DESCRIPTION OF THE INVENTION

Figure 1:
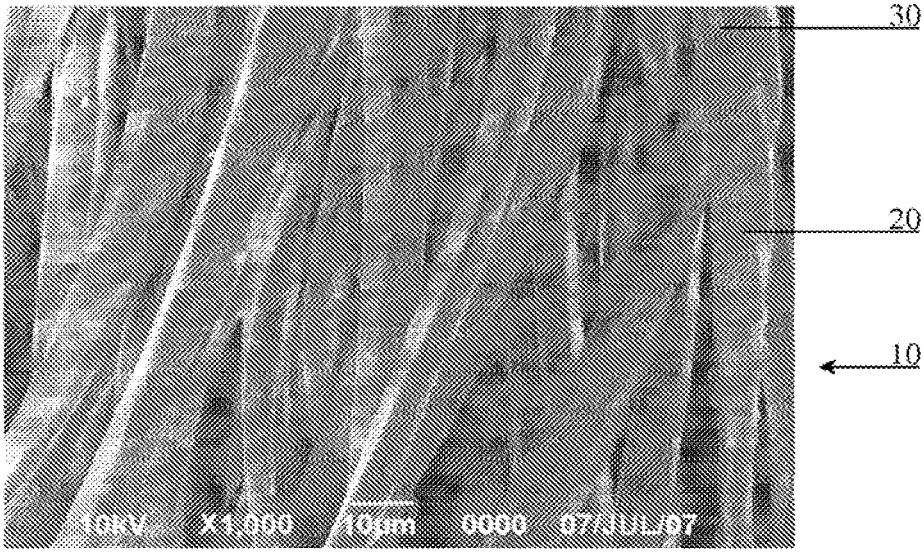
FIG. 1 is a X 1,000 Scanning Electron Microscopy (SEM) diagram of yarns with coffee residues wherein the reference numeral 10 represents yarns with coffee residues, the reference numeral 20 represents a piece of yarn and the reference numeral 30 represents coffee residues.
Figure 2:
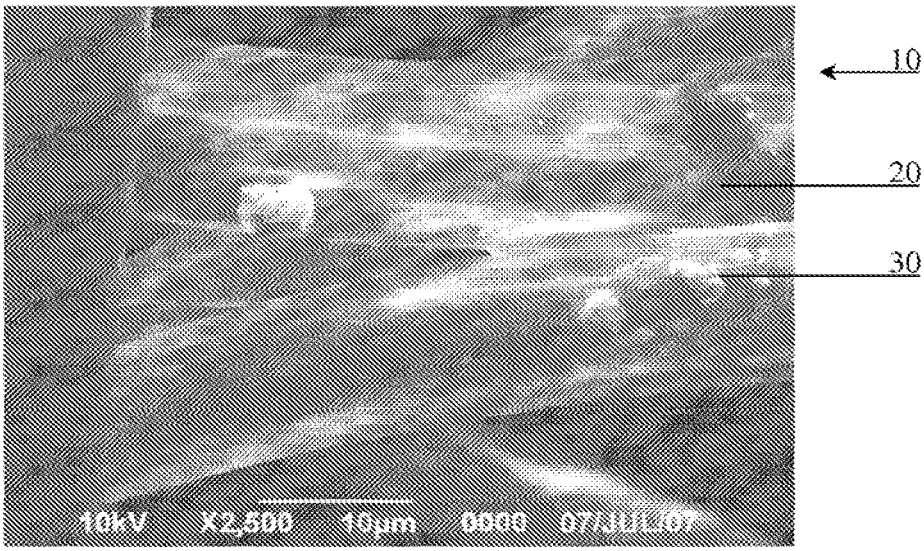
FIG. 2 is a X 2,500 SEM diagram of yarns with coffee residues, wherein the reference numeral 10 represents yarns with coffee residues, the reference numeral 20 represents a piece of yarn and the reference numeral 30 represents coffee residues.
Figure 3:
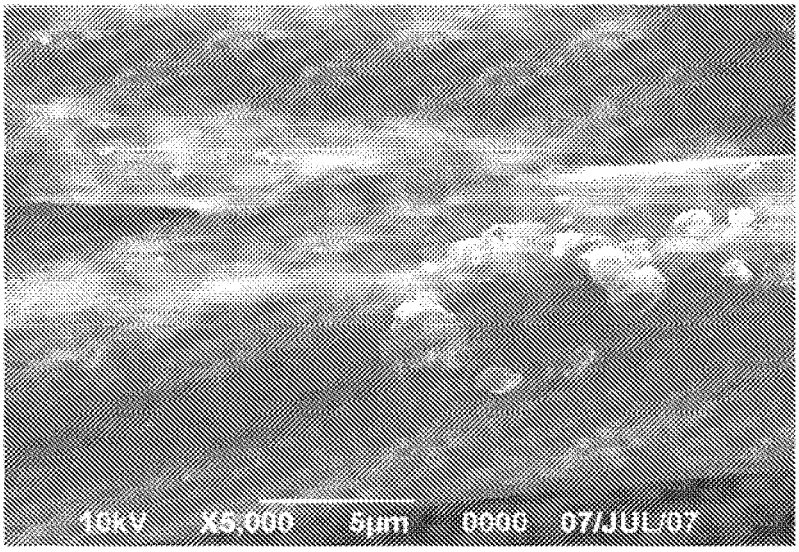
FIG. 3 is a X 5,000 SEM diagram of yarns with coffee residues.

For a long time, coffee residues have been viewed as litter after the beverage coffee had been made. However, the present invention provides an environmentally friendly way to recycle coffee residues by incorporating them into the preparation of yarns.

The present invention relates to a method for preparing a yarn with coffee residues, comprising (a) providing a material with coffee residues; (b) blending the material with a polymer chip to produce a master batch; and (c) drawing a yarn from the master batch. The material used in the present invention is baked coffee residues, microencapsulated baked coffee residues, microencapsulated coffee essential oil, or microencapsulated fragrance organic compounds which are extracted from coffee residues. In the preferred embodiment, the coffee residues are ground coffee beans or coffee dregs. The above mentioned material further comprises a carbonized particle which is prepared from a carbonized coffee particle, a carbonized coconut particle or a carbonized bamboo particle. The carbonized coffee particle is prepared by sieving coffee residues, removing organic contents from the sieved mixture, and then obtaining the carbonized coffee particles from the mixture without organic contents. Furthermore, the polymer chip in the prevent invention is selected from the group consisting of polypropylene (PP), Nylon or polyethylene terephthalate (PET).

The present invention also provides a yarn comprising a yarn and a material with coffee residues. In a preferred embodiment, the coffee residues have a coffee fragrance. The material further comprises a carbonized particle. In addition, this yarn can be used to make garments.

The present invention also provides a yarn with a coffee fragrance, comprising a yarn which is prepared by the above mentioned method and a material with coffee residues which has a coffee fragrance. The material further comprises a carbonized particle. In addition, this yarn can be used to make garments.

The present invention further provides a fabric comprising one of the above mentioned yarns with coffee residues. The fabric is a non-woven fabric, a woven fabric, a knitted fabric, a viscose fabric, or a padded fabric.

EXAMPLES

Example 1: Preparation of Material with Coffee Residues and Carbonized Coffee Particles Step 1. Preparation of Material with Coffee Residues The term "material with coffee residues" includes but is not limited to baked coffee residues, microencapsulated baked coffee residues; microencapsulated coffee essential oil; and microencapsulated fragrance organic compounds which are extracted from coffee residues. Coffee residues can be ground coffee beans or coffee dregs from a coffee shop. Then, the coffee residues are baked. Coffee essential oil can be extracted from coffee beans. The baked coffee residues or coffee essential oil are microencapsulated.

Step 2. Sieving Coffee Residues or Raw Material

The coffee bean waste is rinsed in clean tap water, and then dried and ground to a particle size of 20 to 100 microns. Ground coffee beans are directly sieved. Alternatively, coffee dregs are dried and ground. Then, the ground mixture is sieved. The resulting composition can be sieved into different fine particles with sizes from 80 to 100 μm.

Step 3. Removal of Organic Contents of Sieved Mixture

A portion of the sieved mixture obtained from step 2 is extracted by organic solvent to remove the organic contents of the mixture. The extraction of fat is carried out in a large Soxhlet type extractor with ethyl ether. The temperature of the extract is kept below 60° C. In all subsequent operations, air is excluded as far as possible by the use of inert gases and all solvents are freshly distilled. The lipids are treated with acetone to remove the phospholipids, after which the acetone-soluble fat is recovered and saponified by refluxing with an excess of 5% alcoholic potassium hydroxide solution. The soap solution is acidified with 0.1N hydrochloric acid and the fatty acids are extracted with ether. After the fatty acids are removed, the aqueous solution containing water-soluble constituents is evaporated to dryness under reduced pressure and extracted with absolute alcohol for the removal of glycerol.

Step 4. Preparation of Carbonized Particles

The remaining portion of the sieved mixture obtained from step 2 is carbonized by carbonization known in the state of the art. For example, pyrolysis is the process in which the coffee mixture is heated, decomposed and eventually converted into the desired product in the absence of air in a fixed bed reactor. Pyrolysis includes carbonization (destructive/dry distillation of wood), charcoal processing, gasification, and activated carbon processing. The pyrolysis products are wood charcoal and activated carbon. The carbonization of the coffee raw materials is normally done in the presence of chemical agents such as zinc chloride, magnesium chloride, calcium chloride or phosphoric acid. The carbonized material is treated with an oxidizing gas in a furnace at 800° C.-1000° C. under conditions that permit the removal of nearly all of the adsorbed hydrocarbons and some of the carbon to increase the surface area.

Before subjecting the carbonized material to activation, it is washed with either an acid or a base depending upon the chemical used for carbonization to remove all the traces. Then, it is charged for activation. Various methods are used for the activation process, but the most widely used is the treatment of the carbonaceous material with oxidizing gases such as air, steam or carbon dioxide. This technique is generally used for the activation of a coffee mixture, subsequent to carbonization. The charcoal is activated by reaction with steam at a temperature of 800° C.-1100° C. under controlled atmosphere in a fluidized bed reactor to facilitate uniform heat distribution and improved contact between gas and solid phases. The reaction between steam and charcoal takes place at the internal surface area, creating more sites for adsorption with liberation of gases such as $H_2$, $CO_2$ and CO.

Initially, gasification of the carbonized material with steam occurs and the following reaction, known as the Water-Gas reaction, takes place:

$$C+H_2O \rightarrow CO+H_2-175{,}440 \text{ kJ/(kg mol)}$$

This reaction being endothermic, temperature is maintained by partial burning of the CO and $H_2$ formed, as follows:

$$2CO+O_2 \rightarrow 2CO_2+393{,}790 \text{ kJ/(kg mol)}$$

$$2H_2+O_2 \rightarrow 2H_2O+396{,}650 \text{ kJ/(kg mol)}.$$

Step 5. Preparation of Master Batch

75% of the carbonized particles and 25% of the material with coffee fragrance are mixed and ground to fine particles of less than 5 μm; then, the ground particles and polymer chip (such as PP, Nylon or PET) in a weight ratio of 1:9 are blended to prepare a master batch. Alternatively, 75% of the carbonized particles and 25% of the material with coffee fragrance are blended into polymer chip (such as PP, Nylon or PET) to a make master batch.

Step 6. Drawing Yarn

The master batch is made in industrially accepted concentrations and added to a polymeric slurry the same way any other master batch would be added such as for pigmentation, etc. As stated in Billie J. Collier et al., Understanding Textiles sixth edition, pressed by Prentice Hall, the master batch is designed in such a way as to allow fiber extrusion in normal production systems. The fibers can be cut into short staples or produced in a filament form and texturized, if so desired. The product yielded is a fiber that can be introduced at the blending stage of yarn production or directly into a woven or knit product so that no manufacturing processes are changed.

What is claimed is:

1. A yarn with coffee residues comprising:

a yarn and a material with coffee residues whose organic contents have been removed.

2. The yarn with coffee residues of claim 1, wherein the material with coffee residues has a coffee fragrance.

3. The yarn with coffee residues of claim 1, wherein the material with coffee residues further comprises a carbonized particle.

4. The yarn with coffee residues of claim 1 which is prepared by (a) providing material with coffee residue whose organic contents have been removed; (b) blending the material with a polymer chip to produce a master batch; and (c) drawing a yarn from the master batch.

5. A fabric comprising the yarn with coffee residues of claim 1.

6. The fabric of claim 5, wherein the material with coffee residues has coffee fragrance.

7. The fabric of claim 5, wherein the material with coffee residues further comprises a carbonized particle.

8. The fabric of claim 5, wherein the fabric is a non-woven fabric, a woven fabric, or a knitted fabric.

9. A garment comprising one of the yarn with coffee residues of claim 1.

10. The garment of claim 9, wherein the material with coffee residues has coffee fragrance.

11. The garment of claim 9, wherein the material with coffee residues further comprises a carbonized particle.

* * * * *